US008555759B2

(12) United States Patent
Caughey, Jr.

(10) Patent No.: US 8,555,759 B2
(45) Date of Patent: Oct. 15, 2013

(54) DRAWING TICKET DISPENSER

(76) Inventor: Philip Caughey, Jr., La Verne, CA (US)

( * ) Notice: Subject to any disclaimer, the term of this patent is extended or adjusted under 35 U.S.C. 154(b) by 253 days.

(21) Appl. No.: 13/010,903

(22) Filed: Jan. 21, 2011

(65) Prior Publication Data

US 2012/0187139 A1 Jul. 26, 2012

(51) Int. Cl.

| | |
|---|---|
| ***B26D 5/00*** | (2006.01) |
| ***B26D 5/20*** | (2006.01) |
| ***B26D 7/06*** | (2006.01) |

(52) U.S. Cl.
USPC ..... 83/47; 83/242; 83/408

(58) Field of Classification Search
USPC ..... 83/337, 42, 43, 44, 47, 242, 408; 221/1, 221/30
See application file for complete search history.

(56) References Cited

U.S. PATENT DOCUMENTS

| | | | | |
|---|---|---|---|---|
| 1,993,951 | A * | 3/1935 | Ashe | 83/208 |
| 2,444,019 | A * | 6/1948 | Krueger | 83/28 |
| 2,937,554 | A * | 5/1960 | Nathan | 83/203 |
| 4,364,501 | A | 12/1982 | Curtiss | |
| 4,881,675 | A | 11/1989 | Varley | |
| 5,211,093 | A * | 5/1993 | Horniak | 83/426 |
| 7,444,911 | B2 * | 11/2008 | Sanda et al. | 83/425.2 |
| 8,043,475 | B2 * | 10/2011 | Shockley et al. | 162/147 |
| 2007/0204737 | A1 * | 9/2007 | Finkenbiner | 83/649 |

* cited by examiner

*Primary Examiner* — Sean Michalski
*Assistant Examiner* — Jonathan G Riley
(74) *Attorney, Agent, or Firm* — Philip H. Haymond

(57) ABSTRACT

A device and method for separating tickets from a roll of raffle tickets having two or more strands, the individual tickets being transversely joined to twin tickets having corresponding identical identifiers. The strands are separated longitudinally into individual strands and at least one strand, the seller's tickets, is further separated transversely into individual tickets for use in a hopper to draw a winning ticket.

20 Claims, 8 Drawing Sheets

DRAWING TICKET DISPENSER

RELATED APPLICATIONS

This application is a continuation-in-part of and hereby incorporates by reference and claims the priority filing date of U.S. patent application Ser. No. 12/894,520, filed Sep. 30, 2010, inventor Philip Caughey, Jr., entitled DRAWING TICKET DISPENSER, which cites for priority U.S. provisional patent application Ser. No. 61/249,598, filed Oct. 7, 2009, inventor Philip Caughey, Jr., and is entitled DRAWING TICKET DISPENSER.

COPYRIGHT NOTICE

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD OF THE INVENTION

This invention relates to ticket dispensers and more particularly to a method and apparatus for dispensing tickets from a double or twin roll of tickets of the type typically used for a drawing such as a raffle, a door prize or other function requiring the issuance of identically-identified tickets.

BACKGROUND OF THE INVENTION

Tickets for raffle and door prize drawings are typically dispensed from a roll of tickets made up of double or twin strands of tickets, where each individual ticket has a twin with a corresponding identifier such as a serial number. A double or twin roll of tickets is a roll of two strands of tickets having twin tickets joined longitudinally, lengthwise, and also joined to preceding and succeeding tickets at a each end at the transverse axis of the ticket. Each ticket is typically perforated at its joined edges for easy detachment by tearing, where it joins its twin and the preceding and succeeding tickets. The Double Raffle Ticket Roll products currently sold by the Century Novelty company of Livonia, Mich. are examples of such a double roll of tickets, the Blue Double Raffle Ticket Roll, item number 427-041 for example.

The tickets of each set of twin or even multiple tickets are twins because they are marked with a common identifier, usually identical serial numbers, to reflect that they are twin tickets. Each successive set of twin or multiple tickets are marked with the same identifier. In a typical raffle when a buyer purchases a ticket he is given that ticket and the twin of that ticket is kept by the seller to be used in a drawing. One of the twin tickets is given to the buyer as proof that he purchased a ticket with a particular identifier and the other is kept by the seller to be placed in a hopper or other container, so that it may by chance be randomly selected by the seller as the winning ticket. If the buyer has the twin of the winning ticket it can be presented to the seller for whatever prize is being awarded for that raffle contest.

Dispensing these tickets therefore requires a user, the seller, to split or tear the double roll into two strands, one for the buyer and one for the seller to keep. Most buyers prefer to have their purchased buyer's tickets kept intact as a strand when they purchase more than one ticket. The seller however must usually also tear the twin strand of seller's tickets transversely at each end to make it into an individual ticket, to be placed in the container for the later drawing.

This task requires the repetitive and laborious tearing of tickets along their length and then at the ends. The task is also time-consuming, potentially making buyers wait in long lines to buy their tickets.

What is needed then is a ticket dispenser that will dispense raffle tickets while tearing a double roll of tickets into two twin strands and further cutting the strand of seller tickets into individual tickets for the drawing.

SUMMARY OF THE INVENTION

Figure 1:
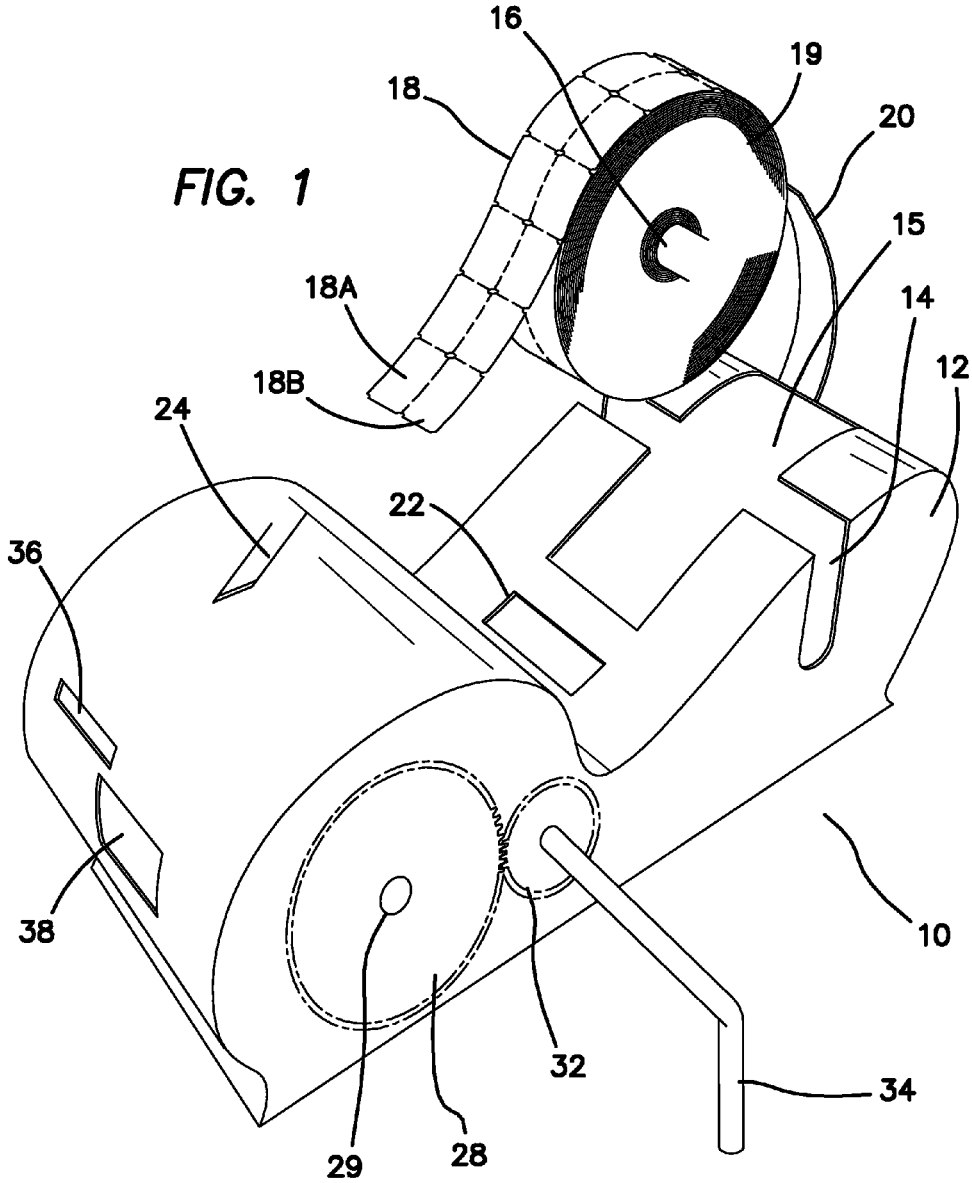
FIG. 1 is a perspective cutaway view of an embodiment of a raffle dispenser of the present invention.
Figure 1A:
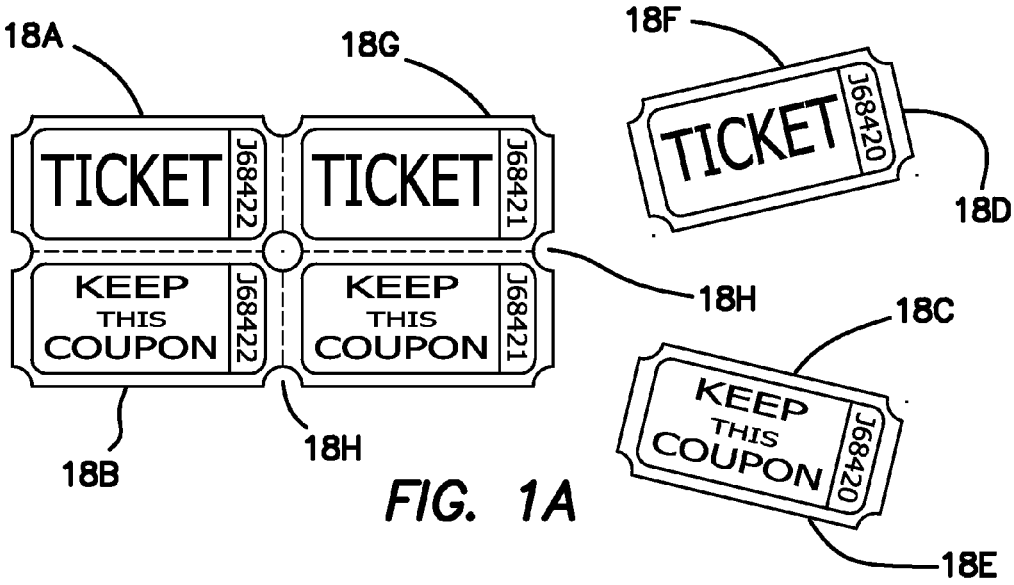
FIG. 1A is an exemplary section of twin tickets.

A solution to the above has been devised. The invention comprises a double ticket roll dispenser that separates a roll of twin tickets into two strands along the central longitudinal lengthwise perforation of the double roll of tickets as they are dispensed and further cuts the seller's strand of tickets transversely along the transverse perforation into individual tickets.

A dispenser for separating a ticket roll having twin or multiple strands of tickets with common identifiers is disclosed. There is a feed mechanism for feeding tickets from a ticket roll having notches when there are two or more strands of tickets with common identifiers for longitudinally adjoining tickets. Various blades for cutting the ticket strands longitudinally and transversely are provided so that the blades cut the buyer's tickets into a continuous individual strand or strands for the buyers tickets, allowing the buyer to be presented with a continuous strand of purchased tickets. At the same time the dispenser cuts the seller's tickets transversely into individual tickets to be placed in a hopper or other container for selecting a winning ticket.

In the preferred embodiment the cutting mechanism comprises a driven wheel that has lugs corresponding to notches on the tickets and uses the notches to pull the ticket roll. There are at least two blades used to separate the tickets, a transverse blade for making cuts transversely across the tickets and a longitudinal blade for cutting the tickets into individual strands. The longitudinal blade may be a fixed blade or in the preferred embodiment a cutting wheel. In either case it is preferred that a central groove be formed in the driven ticket wheel to allow the blade to extend through tickets mounted on the ticket roll.

The driven wheel is mounted on an axle and includes spokes with an actuator arm mounted on each spoke on a hinge boss formed on each spoke. It may be driven manually or with a motor, and the motor may be control by a central processing unit. The actuator arm is pivotally attached at one end to the hinge boss and oriented in a direction to extend through the driven wheel. There is a transverse blade affixed to the end of the actuator arm distal the pivotal attachment and oriented in a direction towards the slit. A stationary cam is mounted around the axle so that when the driven wheel is rotated, moving the actuator arm past the cam, the actuator arm pivots and the transverse blade moves through the slit, cutting the ticket transversely.

The transverse and longitudinal cuts are made near each other to allow the buyer's strands and the seller's tickets to emerge from the dispenser at the same time.

DESCRIPTION OF THE INVENTION AND PREFERRED EMBODIMENT

The following description, and the figures to which it refers, are provided for the purpose of describing examples and a specific embodiment of the invention only and are not intended to exhaustively describe all possible examples and embodiments of the invention.

While a double roll of tickets is used for the detailed illustration, it should be understood that the present invention can be adapted to work with any multiply-stranded roll of identically-marked tickets as well, triple or quadruple rolls for example, with additional sets of the same components, recited below, being added to accommodate each additional strand. Nor should the use of the present invention be limited in use to raffle or door-prize drawing activities, the present invention can be used in any activity where there is a need to dispense double or multiple rolls of tickets. For purposes of illustration however a twin or double roll of tickets is used herein.

Figure 2:
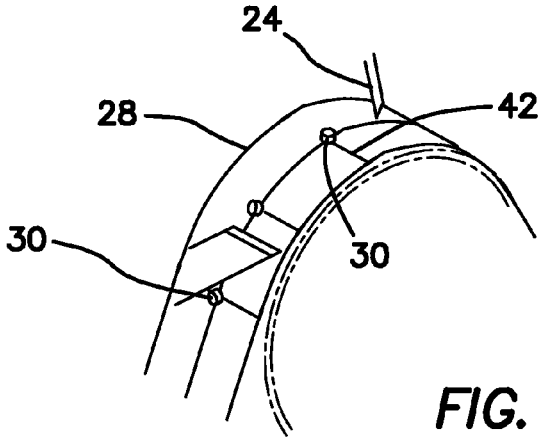
FIG. 2 is a partial detail view of the driven ticket wheel of FIG. 1.
Figure 3:
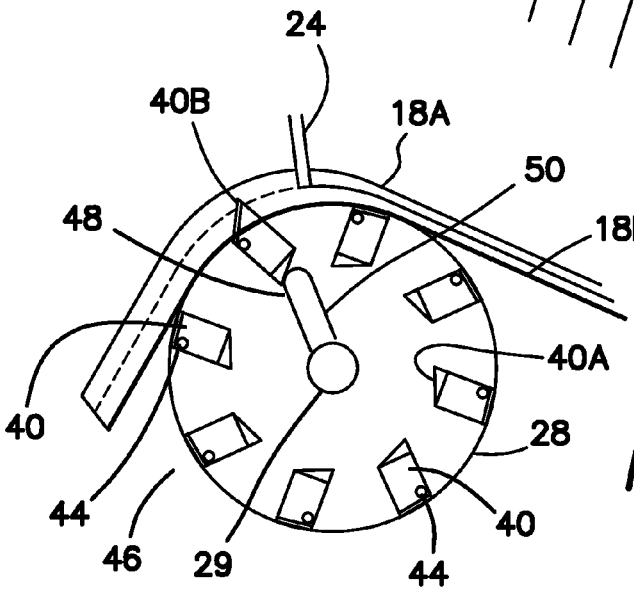
FIG. 3 is a partial detail view of the driven ticket wheel of FIG. 1.

Referring now to FIGS. 1 through 3 a typical double raffle roll 18 consists of two strands, a strand 18A of buyer's tickets and a strand 18B of seller's tickets, joined longitudinally at a longitudinal perforation 18C and the ends of two adjoining tickets joined at transverse perforations 18D. The adjoining or paired twin tickets, individual buyer's ticket 18E and individual seller's ticket 18F, have identical corresponding identifiers 18G such as the same serial number. Ticket notches 18H are provided at the ends of the tickets, bisected by the transverse perforations 18D defining the common ends of a pair of twin tickets 18E and 18F.

In a first embodiment of the present invention, ticket dispenser 10 is shown in the drawings. The ticket dispenser 10 includes a housing 12 having slot 14 adapted to receive ticket roll axle 16 upon which a double ticket roll spool 19 is mounted. Housing 12 also has a slot 15 to receive double ticket roll spool 19 inserted in the direction of arrows shown in this illustration, the roll 18 comprising two strands of twin tickets along the length of the roll, ticket roll strand 18A of buyer's tickets, and ticket roll strand 18B of seller's tickets. The ticket roll 18 and spool 19 are prevented from free-wheeling on its axle 16 by spring tensioned bar for ticket roll 20. Together these elements provide a feed mechanism for a driven ticket wheel 28.

The housing 12 also includes ticket feed opening 22 and a knife blade 24 that is fixedly mounted in a void in the housing 12 adapted to receive the blade and situated to cut the ticket roll into two strands as it moves. The housing 12 is configured so that the ticket roll 18 is fed into a driven ticket wheel 28, which is also mounted on an axle 29 in the housing 12. The tickets are fed from the ticket roll 18, through the ticket feed opening 22 and then to the geared driven ticket wheel 28.

The tickets are pulled on the gear driven ticket wheel 28 by advance pins 30 to pull a ticket by notch 18H or an equivalent traction surface formed on the face of the ticket wheel that grasps the tickets. The geared ticket wheel is driven by a complementary geared drive wheel 32, mounted on an axle (not shown) in the housing 12. The geared drive wheel 32 is adapted to receive a hand crank 34 that is turned by the user to turn the driving 32 and driven wheels 28. It is preferred that the drive wheel 32 be adapted to receive the hand crank 34 on either side of the geared drive wheel 32, making the ticket dispenser 10 ambidextrous, to accommodate both a left-handed or right-handed user.

As the hand crank 34 is turned the tickets of ticket roll 18 are pulled by geared driven ticket wheel 28 they are pulled around knife blade 24 to split the ticket roll into strands, strand 18A of buyer's tickets, and ticket roll strand 18B of seller's tickets. The buyer's tickets 18A emerge as a strand through an opening 36 in the housing 12 for buyer's tickets, and the seller's tickets 18B emerge as individual tickets though an opening 38 in the housing for seller's tickets.

Figure 4:
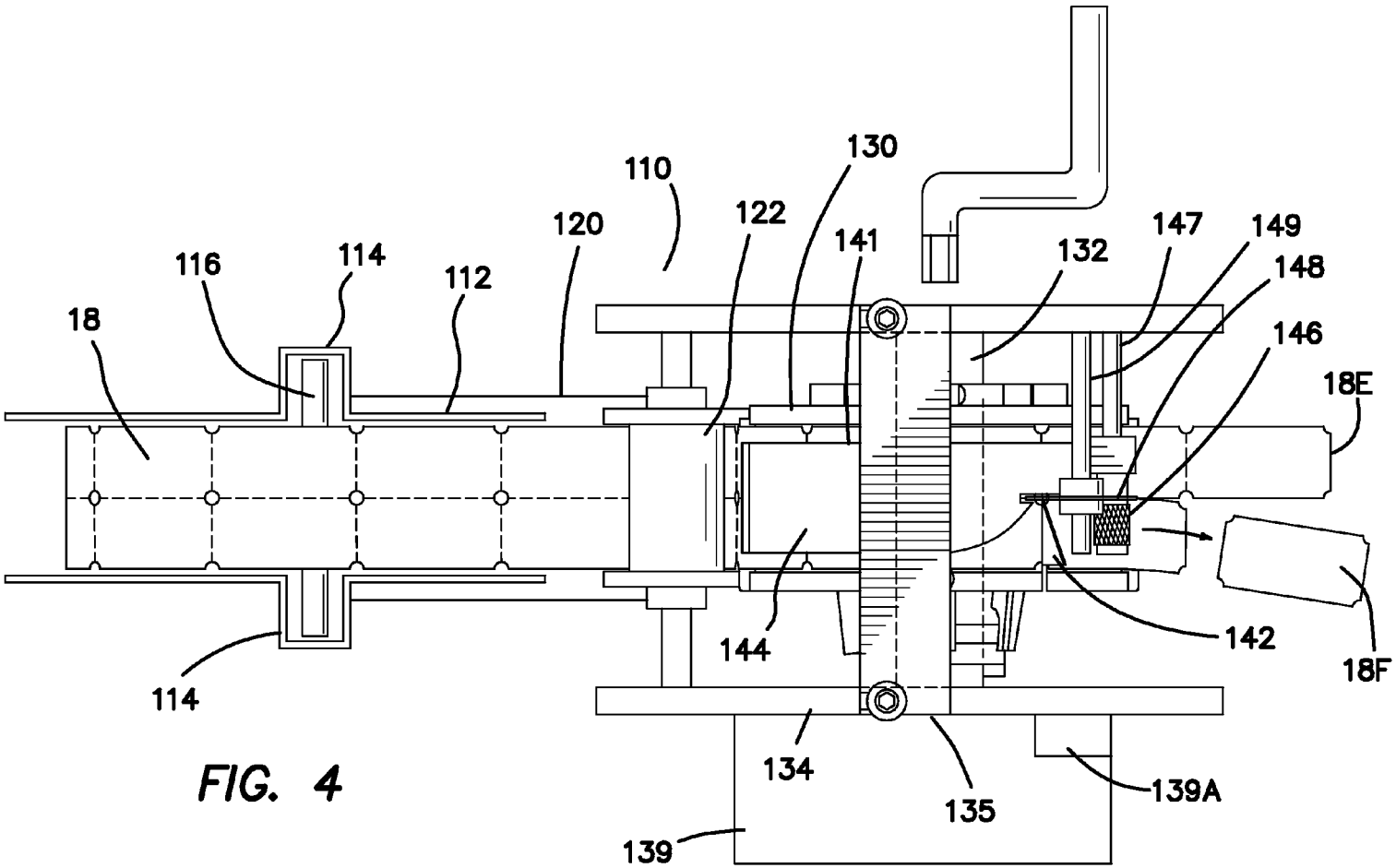
FIG. 4 is top schematic view of the of the raffle dispenser of the present invention.
Figure 5:
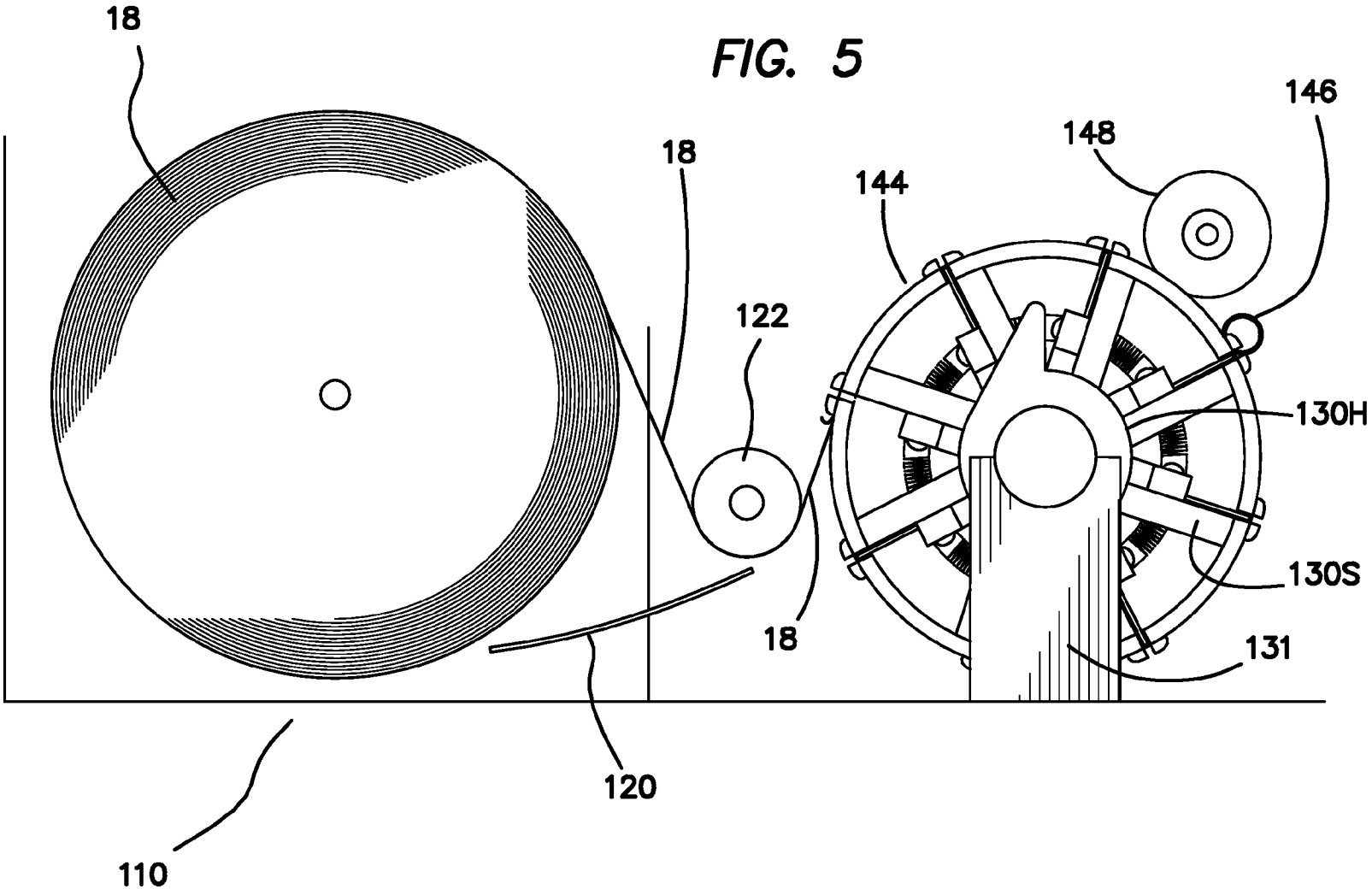
FIG. 5 is a side schematic view of the preferred embodiment of the invention.

In an alternative embodiment a motor (shown in FIG. 4 as 139) having a control circuit such as a CPU 139A replaces the hand crank 34. The implementation of a motor driven unit controlled by an electronic circuit will be apparent to those of skill in the art. In one configuration a small DC motor is used to turn the ticket wheel axle 29 by a cog belt (not shown) or similar mechanical connection. The CPU 39A controls operation of the motor and is programmed to advance the ticket wheel 38 according to user input indicating how many tickets should be dispensed. A microswitch for example, such as a Honeywell 1981 microswitch could be actuated by pins on the wheel to indicate when a ticket has moved, triggered by the movement of the ticket wheel 28 to indicate how many tickets have gone by the wheel. In such an implementation it is preferred to have a series of exterior buttons (not shown) corresponding to the quantity of tickets desired to be dispensed, as follows, one, five, ten, fifteen and twenty ticket quantities that, when pressed, will automatically dispense the corresponding number of raffle tickets. With either a purely mechanical, electro-mechanical or CPU-controlled motor actuated embodiment, a ticket counter can be employed to display the number of tickets sold, the implementation of which will be apparent to those of skill in the art.

The opening for buyer's tickets 36 and the opening for seller's tickets 38 are preferably situated in the housing or otherwise adapted to have each twin of twin tickets emerge simultaneously from their respective openings.

The gear-driven wheel 28 is further designed to cut the seller's ticket strand 18B transversely into individual tickets. Gear driven ticket wheel 28 includes a series of transverse blades 40 arranged radially around the wheel, each transverse blade having an angled end 40A, and also a blade cutting end 40B, the blade cutting end is oriented outwardly from the center of the wheel 28. There are slits 42 formed in the wheel to allow the blades to emerge radially through the face of the wheel and these slits are separated by a circumferential distance equivalent to the length of a single ticket. The blades 40 pivot on blade pins 44 and are spring-biased by either a spring or of spring steel to be retained within the ticket wheel 28 by transverse blade springs 46. As the ticket wheel 28 is turned, the angled end 40A of the transverse blade is driven onto transverse blade actuator member 48, thereby forcing the cutting end 40B blade 40 radially outward (shown with arrow) and causing blade cutting end 40B to cut the seller's tickets 18B. The tickets must of course initially be aligned on the geared driven ticket wheel 28 by a user so that the transverse blades 40 cut the individual tickets transversely at their ends rather than in the middle of a ticket. In this embodiment the advance pins 30 are arranged on the wheel 28 to keep the ticket so aligned.

In this embodiment the transverse blade actuator member 48 is removable or can be moved away from the transverse blades 40 so that the blades are not forced radially outward during rotation to cut the seller's ticket strand 18B into individual tickets. The actuator member is mounted so as to allow the buyers strand 18B to emerge as an intact strand from opening 38 in the housing 12.

The ticket dispenser 10 may also include a numeric ticket counter (not shown) to keep a tally of the number of tickets dispensed, the implementation of which will be apparent to one of skill in the art.

The ticket dispenser 10 may also include a noise-making device (not shown) to emit a click or other noise to alert the user that a ticket has been dispensed. The retraction of the transverse blades 40 after they pass over the actuator member 48 may provide sufficient sound, but otherwise the implementation of a noise making device will be apparent to one of skill in the art.

Referring further to FIGS. 4 through 8, the preferred embodiment of the present invention, ticket dispenser 110 is shown. The ticket dispenser 110 includes ticket roll mount 112 having a slot 114 adapted to receive ticket roll spool axle 116 and a slot 115 adapted to receive a double ticket roll 18. Together these elements provide a feed mechanism for a driven ticket wheel 130.

Tickets of a ticket roll 18 are guided with a guide plate 120 to a guide pulley tensioning wheel 122 provided between a ticket roll 18 and a driven ticket wheel 130 to guide and align the tickets of the ticket roll 18 to the driven ticket wheel. The driven ticket wheel 130 is covered by a ticket wheel stay plate 144 to keep the tickets against the driven ticket wheel. The ticket wheel 130 has an axle 132 adapted on each end to receive a hand crank 134 that can be turned to rotate the ticket wheel and, because the crank can be inserted in either end of the axle, allows ambidextrous operation of the ticket dispenser. The axle 132 is fitted within a second housing wheel mount 131 with a slot 135 adapted to receive and mount the ticket wheel axle.

A knife or knife wheel blade 148 is mounted on a stud 149 to cut the tickets of the ticket roll 18 longitudinally at the longitudinal perforations 18C into separate strands as they pass on the rim 130R. A knurled ticket stay wheel 146 mounted on a knurled ticket stay wheel stud 147 extends out over the sellers ticket strand to retain the sellers ticket 18B against the rim 130R. As the tickets of the ticket roll 18 are cut into buyers 18A and seller' 18B ticket strands, knurled stay wheel 146 holds each seller's ticket against the rim 130R for as it is cut longitudinally for additional transverse cutting on the transverse ticket perforations 18D into an individual seller's ticket.

As with the first embodiment a motor 139 having a control circuit such as a CPU 139A can supplement or replace the hand crank 34 to drive the ticket wheel 130. The implementation of a motor driven unit controlled by an electronic circuit will be apparent to those of skill in the art. This implementation can be implemented in the same manner as that of the earlier embodiment with a CPU controlling operation of the motor and programmed to advance the ticket wheel 130 according to user input with a series of five exterior buttons corresponding to the number of tickets desired to be dispensed in the one, five, ten, fifteen and twenty ticket 20 quantities of the earlier embodiment that automatically dispenses the corresponding number of raffle tickets.

Figure 6:
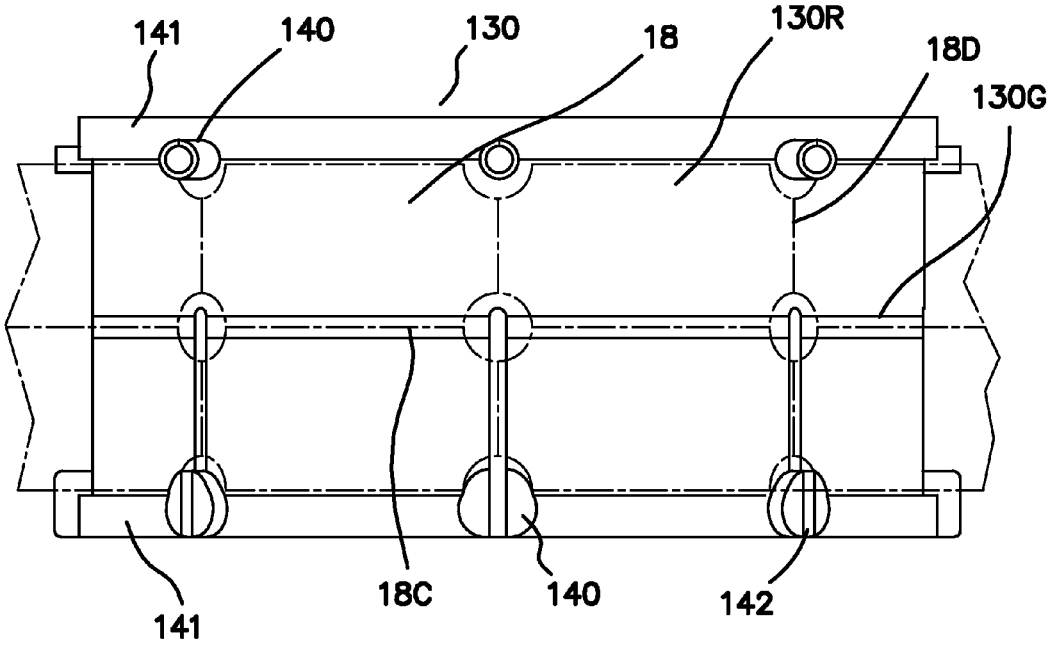
FIG. 6 is a sectional side detail view of the rim of the driven ticket wheel of FIG. 4.
Figure 8:
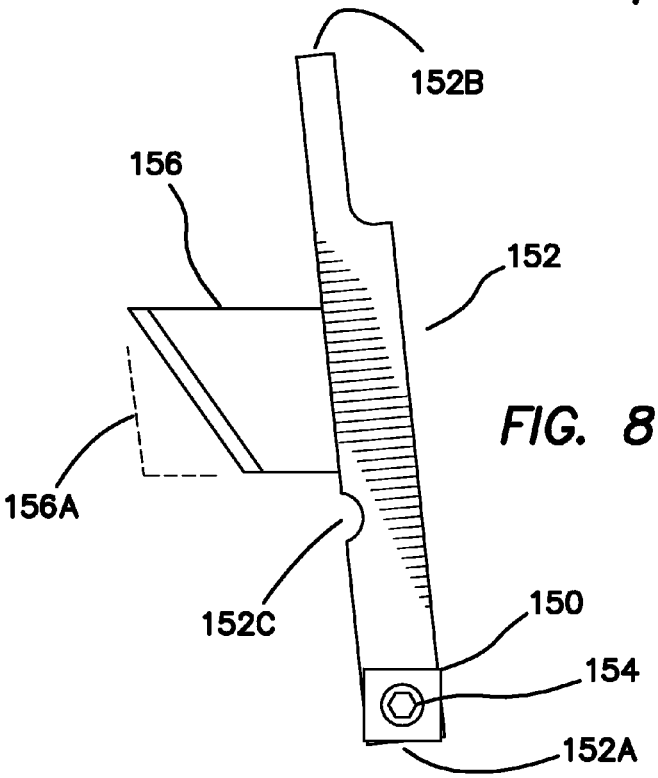
FIG. 8 is a side view of a transverse blade actuator arm.
Figure 11:
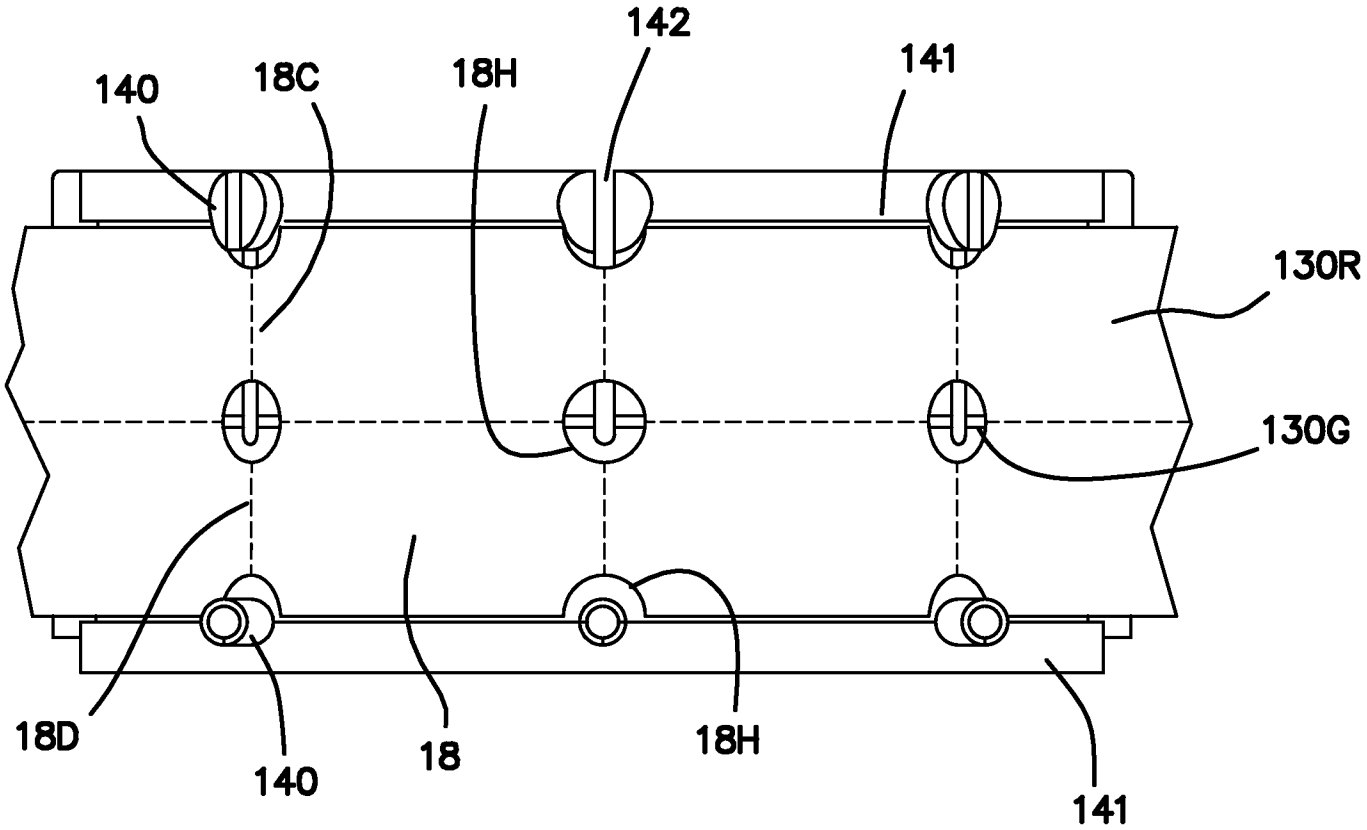
FIG. 11 is a sectional side detail view of the rim of the driven ticket wheel during ticket splicing.

In FIGS. 6 and 11 top detail views of the rim 130R of the driven ticket wheel 130 are shown. The rim has raised edges 141 spaced apart by the width of the tickets of a ticket roll 18 and is provided with advance lugs 140 spaced and sized to receive the corresponding notches 18H formed the ticket roll 18, together fitted to grasp and move the tickets across the rim 130R as the ticket wheel 130 is rotated. A driven wheel hub central groove 130G is provided corresponding in position to be under the longitudinal ticket perforations 18C, split by the knife wheel blade 148. The knife wheel blade 148 rests suspended in the groove 130G allowing the blade to cut through the ticket roll 18 at longitudinal perforations 18C for a cleaner cut.

Slits 142 are formed in the side of the wheel rim 130R corresponding to the seller's ticket strand 18B. The slits 142 are also formed to create an advance lug 140, half a lug formed on either side of a slit, positioned across from the corresponding non-slit lug, the distance between the opposite lugs sized to fit snugly within the ticket roll notches 18H of the ticket roll 18. Together the lugs and slit lugs 140 pull the joined twin tickets 18 along the rim 130R of the driven ticket roll 130 as it is rotated. Further, the transverse perforations 18D of the seller's tickets 18B of the ticket roll 18 are thereby aligned with the slits 142. As detailed below, a blade emerges through the slit to slice an individual ticket from the tickets of the seller's ticket strand 18B along its transverse perforations 18D as it is held against the rim 130R by knurled ticket stay wheel 146.

Referring now additionally to FIGS. 7A through 10B the driven ticket wheel 130 includes spokes 130S extending between driven wheel rim 130R to hub 130H, the hub is mounted on axle 132. The axle 132 is mounted on driven ticket gear mount 134 having a slot 135 adapted to receive the ticket wheel axle 132. A transverse blade arm cam 158 is fixedly mounted on the mount 134.

Figure 7B:
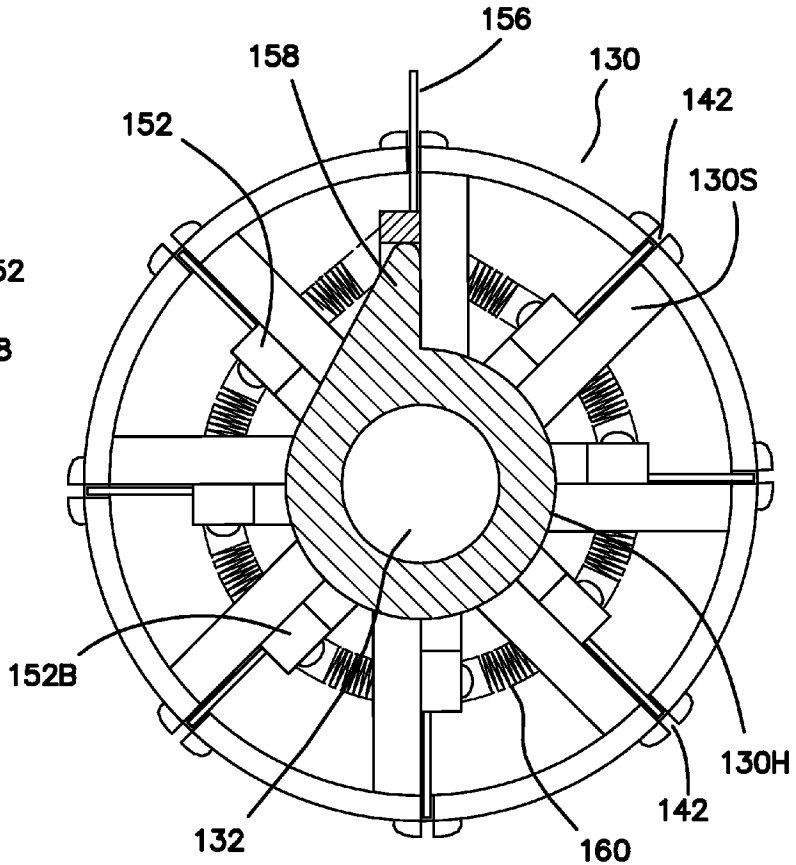
FIG. 7A is a side view and FIG. 7B is a corresponding front view of the ticket driven wheel of the embodiment of FIG. 6.
Figure 7A:
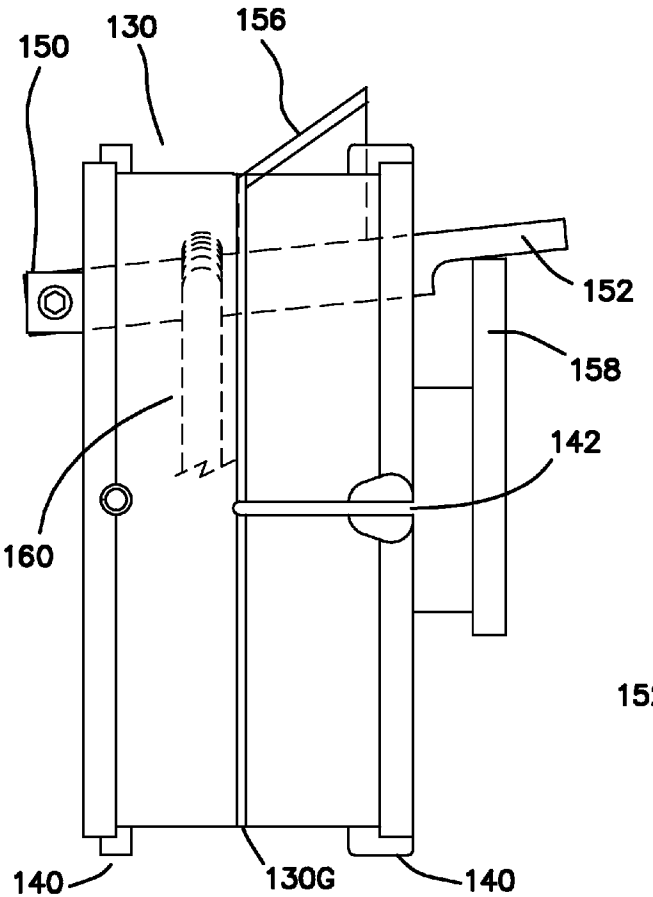

FIG. 7A is a front view and 7B a front side view of driven ticket wheel 130. The spokes 130S of the wheel have a hinge boss 150 formed on one side of each spoke. A transverse blade actuator arm 152, shown in FIG. 8 has a hinge end 152A and a blade end 152B of the arm and a notch 152C for receiving and retaining coil spring 160 (shown in dotted line in FIG. 7A). The hinge end 152A of transverse blade actuator arms 152 arms are pivotally affixed to each hinge boss 150 on each spoke with a pivot pin 154 and oriented in the direction towards the slits 142 of the ticket wheel 130. Although a single actuator arm may be shown in the drawings for illustration, in this embodiment each spoke 130S has a hinge boss and blade actuator arm 152 attached to it. There is further a transverse blade retaining coil spring 160 that passes through all of the blade actuator arm notches 152C of the arms to spring-bias the arms to their position closest to the driven wheel hub 130H.

Figure 9A:
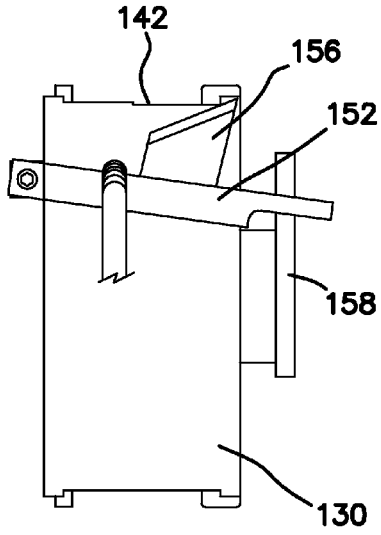
FIG. 9A is a front sectional view and FIG. 9B is a side view of the ticket wheel of the embodiment of FIG. 6, in a first position.
Figure 9B:
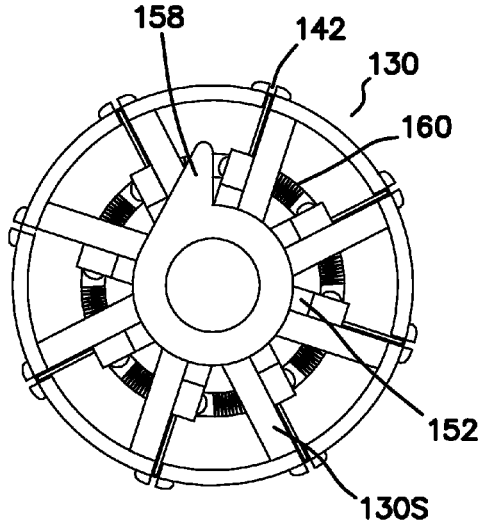
Figure 10A:
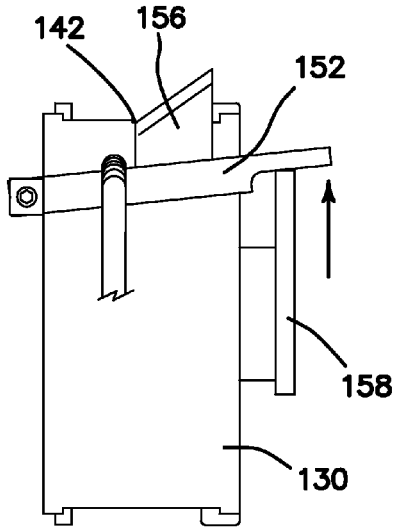
FIG. 10A is a front sectional view and FIG. 10B is a side view of the ticket wheel of the embodiment of FIG. 6, in a second position.
Figure 10B:
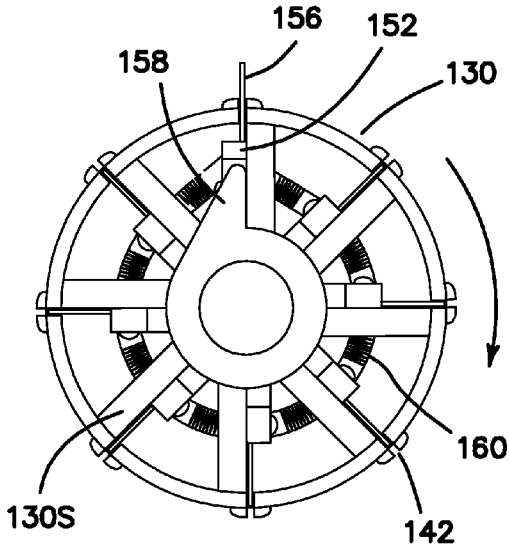

The preferred embodiment of the blade mechanism for making cuts along the transverse perforations 18D of the present invention is detailed in FIGS. 9A-10B. Each spoke 130S includes a curved transverse blade actuator arm 152, although only a single arm is depicted in these figures for illustration. FIGS. 9A and 9B show the driven wheel 130 with the transverse blade actuator arm 152 in a first position, prior to the actuator arm interfering with the cam 158 as the wheel is rotated. FIGS. 10A and 10B show the driven wheel 130 with the actuator arm 152 rotated (motion shown by arrow) to a second, extended position (direction shown by arrow), when the actuator arm interferes with the cam 158 (also shown as direction of arrow in 8A). The slits 142 provided in the rim 130R are oriented with respect to the arms 152 so that, as the arm is moved pivoting on hinge boss 150 to move the blade end of arm 152B towards the rim, each blade 156 passes through its respective slit, thereby emerging from the rim. As the driven wheel 130 is rotated the blade actuator arm 152 interferes with cam 158, forcing the blade arm in a direction away from the hub 130H and the blade 156 through the corresponding slit 142 to make a transverse cut of the seller's ticket 18B. After passing the cam 158 the actuator arm is retracted again to the first position in the direction of the hub 130H by retaining coil spring 160.

The transverse blade 156 is angled, at 156A (dotted line at FIG. 8), mounted at a forty-five degree angle on the arm, a diagonal cut blade like an X-ACTO® #2 blade made by the Elmer's Products, Inc. company of Columbus, Ohio with the long end of the blade furthest from the hinge end 152A of the actuator arm 152. This configuration causes the arm 152 to move through an arc that, when used with an angled 156A blade, the tip of the blade emerges first through the open end of the slit 142 and the rest of the cutting edge of the blade to emerge successively inward through the slit, effectively slicing rather than chopping any ticket mounted on the rim 130R.

To facilitate a clean cut the tickets of the ticket roll 18 are held flat against the rim 130R, as shown in FIG. 11, and in the lugs 140 by ticket wheel stay plate 144 positioned next to the slits blades and knife wheel blade 148.

The two ticket roll strands 18A and 18D of the ticket roll are cut longitudinally along the longitudinal ticket perforations 18C at or near the same location on the rim 103R as the cut to the transverse perforations 18D of the seller's tickets 18B are made. In this manner the longitudinal and transverse cuts are made almost simultaneously. A cover having openings (not shown) corresponding to opening 36 for buyer's tickets and an opening 38 for seller's tickets of the first embodiment are provided in this embodiment too. The openings 36 and 38 are positioned in this embodiment on the cover to allow the individual tickets cut from the seller's ticket strand 18A and the buyer's intact ticket strand 18B to emerge simultaneously through the cover immediately after they have been separated. In this manner the individual seller's tickets can be collected by a user rather than fall within the cover, and the buyer's ticket strand 18A can be manually torn off along its transverse perforation 18D, then presented to the buyer as a strand.

It will be appreciated that the invention has been described hereabove with reference to certain examples or preferred embodiments as shown in the drawings. Various additions, deletions, changes and alterations may be made to the above-described embodiments and examples without departing from the intended spirit and scope of this invention.

What is claimed is:

1. A dispenser for separating a ticket roll having multiple strands of tickets with common identifiers, comprising:

a feed mechanism for feeding tickets from the ticket roll, the ticket roll having a first strand and a second strand of tickets with common identifiers, the ticket strands joined at their length, a first blade for cutting the first and second ticket strands longitudinally and a second blade mounted on a driven ticket wheel for cutting the first strand transversely, whereby, when the ticket roll is dispensed, the second blade, in response to the rotation of the driven ticket wheel, cuts the first strand of tickets into individual tickets, whereby the second strand of tickets is left as a continuous strand of more than one ticket.

2. The ticket dispenser of claim 1, where the ticket strands are notched and the second blade, making the transverse cut, is mounted on the driven ticket wheel that has lugs corresponding to ticket notches and pulls the ticket roll by its notches to position the ticket roll for making the transverse cut.

3. The ticket dispenser of claim 1 where the first blade, cutting the ticket roll into longitudinal strands, is a cutting wheel.

4. The ticket dispenser of claim 1 where the first blade, cutting the ticket roll into longitudinal strands, extends into a central groove formed in the driven ticket wheel to allow the blade to extend through tickets mounted on the ticket roll.

5. The ticket dispenser of claim 2 where the driven ticket wheel further includes one or more slits in the rim of the driven ticket wheel and the second blade, making the transverse cut, passes through the slit to cut the seller's ticket transversely.

6. The ticket dispenser of claim 2 where the feed mechanism further includes a pulley tensioner wheel to guide the tickets to the driven wheel.

7. The ticket dispenser of claim 6 where the tickets are channeled to the pulley tensioner wheel by a guide plate.

8. The ticket dispenser of claim 5 where the driven ticket wheel is mounted on an axle and includes spokes, and one or more spokes have a hinge boss with an actuator arm pivotally attached at one end to the hinge boss and oriented in a direction to extend through the driven wheel;

the second blade is affixed to the end of the actuator arm distal the pivotal attachment and oriented in a direction towards the slit, and a stationary cam is mounted around the axle, whereby when the driven wheel is moved past the cam the actuator arm pivots to move the transverse blade through the slit to cut a seller's ticket strand transversely.

9. The ticket dispenser of claim 8 where the driven wheel is moved by an electric motor.

10. The ticket dispenser of claim 8 where the first blade, cutting the ticket roll into longitudinal strands, is a cutting wheel and extends into a central groove formed in the driven ticket wheel to allow the first blade to extend through tickets mounted on the ticket roll;

the driven wheel is driven by an electric motor, and the feed mechanism further includes a pulley tensioner wheel to guide the tickets to the driven wheel and the tickets are channeled to the pulley tensioner wheel and the tickets are further held against the driven wheel with a ticket wheel stay plate.

11. A method for dispensing and separating a ticket roll having multiple strands of tickets with common identifiers, comprising the steps of:

providing a multiple ticket roll having two or more strands of tickets with common identifiers for longitudinally adjoining tickets and providing a ticket dispenser that can separate two strands longitudinally and one strand transversely causing the dispenser to separate at least two strands longitudinally and one strand transversely, whereby, when more than one ticket of the ticket roll is dispensed the blades cut at least one strand of tickets into individual tickets and leave a second strand as a continuous strand of tickets.

12. The method of claim 11, where the ticket strands are notched and the blade making the transverse cut is mounted on a driven ticket wheel that has lugs corresponding to ticket notches and pulls the ticket roll by its notches while making the transverse cut.

13. The method of claim 11 where the blade cutting the ticket roll into longitudinal strands is a cutting wheel.

14. The method of claim 11 where the blade cutting the ticket roll into longitudinal strands extends into a central groove formed in the driven ticket wheel to allow the blade to extend through tickets mounted on the ticket roll.

15. The method of claim 12 where the driven ticket wheel further includes one or more slits in the rim of the drive wheel and the blade making the transverse cut passes through the slit to cut the seller's ticket transversely.

16. The method of claim 12 where the feed mechanism further includes a pulley tensioner wheel to guide the tickets to the driven wheel.

17. The method of claim 16 where the tickets are channeled to the pulley tensioner wheel by a guide plate.

18. The method of claim 15 where the driven wheel is mounted on an axle and includes spokes, where one or more spokes have a hinge boss and an actuator arm pivotally attached at one end to the hinge boss and oriented in a direction to extend through the driven wheel;

the transverse blade is affixed to the end of the actuator arm distal the pivotal attachment and oriented in a direction towards one of the slits;

a stationary cam is mounted around the axle, whereby when the driven wheel is moved past the cam the actuator arm pivots to move the transverse blade through the slit to cut a seller's ticket strand transversely.

19. The method of claim 18 where the driven wheel is moved by an electric motor.

20. The method of claim 18 where the blade cutting the ticket roll into longitudinal strands is a cutting wheel and extends into a central groove formed in the driven ticket wheel to allow the blade to extend through tickets mounted on the ticket roll;

the driven wheel is driven by an electric motor, and the feed mechanism further includes a pulley tensioner wheel to guide the tickets to the driven wheel and the tickets are channeled to the pulley tensioner wheel and the tickets are further held against the driven wheel with a ticket wheel stay plate.

* * * * *